US005901566A

United States Patent [19]

Macosko et al.

[11] Patent Number: 5,901,566

[45] Date of Patent: May 11, 1999

[54] HEAT PUMP

[75] Inventors: James R. Macosko, Lexington; Brady J. Evans, Olive Hill; Garry A. Harper, West Liberty, all of Ky.

[73] Assignee: Consolidated Technology Corp., Olive Hill, Ky.

[21] Appl. No.: 08/974,780

[22] Filed: Nov. 20, 1997

[51] Int. Cl.[6] ..... F25D 21/14

[52] U.S. Cl. ..... 62/285; 62/324.5

[58] Field of Search ..... 62/259.1, 298, 62/324.1, 324.5, 263, 289, 285, 404, 407, 410, 419

[56] References Cited

U.S. PATENT DOCUMENTS

| | | | |
|---|---|---|---|
| 2,794,624 | 6/1957 | Campagna | 62/259.1 |
| 4,139,052 | 2/1979 | Lackey | 165/59 |
| 4,462,460 | 7/1984 | Braver | 165/26 |
| 4,786,300 | 11/1988 | Uematsu et al. | 62/259.1 |
| 5,140,830 | 8/1992 | Sawyer | 62/298 |
| 5,361,594 | 11/1994 | Young | 62/129 |
| 5,638,695 | 6/1997 | Kamio et al. | 62/279 |

FOREIGN PATENT DOCUMENTS

| | | |
|---|---|---|
| 52-15548 | 9/1977 | Japan . |

*Primary Examiner*—William Doerrler

[57] ABSTRACT

A heat pump which has overlapping chambers and a somewhat s-shaped drain pan disposed between the two chambers provides a low profile, compact design. The chamber for circulating conditioned air has two air intake openings, one for a duct return and one for free return and a somewhat diagonally positioned evaporator/condenser coil. The drains are fully trapped within the housing of the heat pump for convenience in installation.

20 Claims, 10 Drawing Sheets

HEAT PUMP

BACKGROUND OF THE INVENTION

1. Field of the Invention

This invention pertains to an indoor heat pump for use in a confined space.

2. Description of the Prior Art and Objectives of the Invention

With the advent of apartment living, manufacturers of heating and cooling appliances were faced with a need to conserve space used by their appliances. While compact heat pumps and other combined technologies helped alleviate some of the space concerns, there is still a strong felt need to economize on the space used by heating and cooling devices. Numerous types have been built which attempt to make such appliances smaller, or otherwise reduce the space required. These include U.S. Pat. Nos. 4,598,558; 5,140,830; 5,533,346 and 5,271,242. While these devices are improvements over the art of the time, there are still pressures to reduce the size of the appliances and to conserve valuable indoor space.

Likewise, there is a need to provide a heat pump which is easily adapted to condition air that is returned to the heat pump by a duct or a free return vent. Such a device would allow installers to use identical heat pumps in a number of different installation configurations, and thus, reduce the inventory of the installer or supplier.

There is an additional need for a self-contained heat pump which is readily installed without extensive additional plumbing to accommodate condensate drainage. Conventional heat pumps are trapped exteriorly of the heat pump housing and thus require additional installation and plumbing work.

With the above needs in mind, it is an objective of the present invention to provide a heat pump which has a very small footprint and thus takes up little floor space.

It is a further objective of the present invention to provide a heat pump which is only about 180 cm tall.

It is still a further objective of the present invention to provide a heat pump which has a drain trap fully contained within its housing.

It is yet a further objective of the present invention to provide a heat pump which has a diagonally positioned coil in fluid communication with two different air intake openings, namely a duct return, and a free return.

It is another objective to provide a heat pump with vertically overlapping interior chambers to effectively shorten the height of the heat pump.

It is still another objective to provide a heat pump with a drain pan that substantially covers the footprint of the heat pump.

It is yet another objective to provide a somewhat s-shaped drain pan in order to accommodate overlapping chambers.

These and further objectives and advantages will become apparent to those skilled in the art upon reference to the following detailed description.

SUMMARY OF THE INVENTION

The aforesaid and other objectives are realized by a heat pump having a metal housing, which defines a footprint which is smaller than prior heat pumps' footprints. The height of the metal housing is about 67 inches or 170 cm tall. Inside the housing, two main chambers are configured; the first chamber for circulating conditioned air is positioned over the second chamber, which circulates outside or unconditioned air. The first chamber includes two intake openings and one exhaust opening. The first intake opening is a free return intake on the front of the housing. The second intake opening is placed on the side of the housing proximate the first intake opening and is adapted for use with air duct returns. A first conventional evaporator/condenser coil is placed inside the first chamber at a diagonal position in the housing so as to communicate fluidly with both intake openings. Also, located inside the first chamber is a conventional indoor blower such as a centrifugal fan, which draws air across and through the evaporator/condenser coil. Thereafter, the air passes out the exhaust opening, across a conventional auxiliary electric resistive heating element, and into a duct system for return to the conditioned space. The first chamber's floor comprises a drain pan which substantially spans the footprint of the housing and has a somewhat s-shaped configuration. This s-shape effectively creates a first two-level floor or drain shelf, with the lower level being positioned under the first evaporator/condenser coil for support thereof. The indoor blower is mounted on and attached directly to the housing of the heat pump within the first chamber.

The second chamber, which is below the first circulates unconditioned or outside air. The housing defines a third intake opening and a second exhaust opening, which are in fluid communication with the second chamber and are preferably located on the back of the housing. Unconditioned air enters the intake opening and passes across and through a second conventional evaporator/condenser coil. A conventional outdoor air blower moves the air through the second chamber and out the second exhaust opening. The second evaporator/condenser coil is vertically positioned within the second chamber and extends upwardly towards the aforementioned first drain shelf. The second evaporator/condenser coil abuts the higher level of the drain shelf, thus effectively, vertically overlapping the first chamber evaporator/condenser coil to allow the vertical height of the housing to be shortened to about 170 cm. The second chamber has a second shelf, which also has a generally s-shaped configuration. The second evaporator/condenser coil rests on the lower level of this second drain shelf. A conventional compressor rests on the upper level of the second shelf. Proximate the compressor are a usual expansion valve and reversing valve for control of the cooling agent in the evaporator/condensers, as is well understood. On the front of the housing, proximate the second chamber, is a control box which is easily accessible. Romex connectors allow electrical power to be connected easily to the control box. It should be noted that all the components of the present invention are capable of being serviced from the front of the unit, although the control box is removed to service the lower blower assembly. The unit can be installed in the interior of a building with the outside air ducted into and out of the back of the unit, or it can be installed against an outside wall using a wall sleeve and louver to handle the unconditioned air. An additional front panel allows access to the Schrader valves for pressure readings. The second shelf also doubles as a second drain pan.

Immediately below the second shelf is a third chamber which includes the floor of the housing. Within this third chamber is a fully trapped drain line which can exit the housing from either the front or the back of the housing, although a side exit proximate the floor of the housing is preferred.

DETAILED DESCRIPTION OF THE PREFERRED EMBODIMENT AND OPERATION OF THE INVENTION

Figure 2:
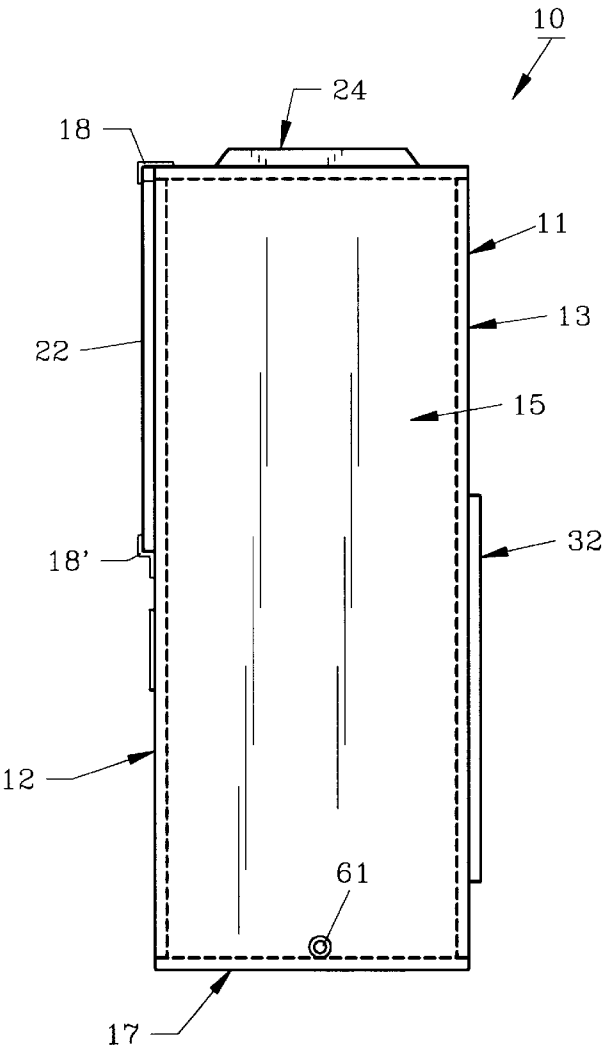
FIG. 2 illustrates an elevational right side view of the heat pump of FIG. 1.
Figure 1:
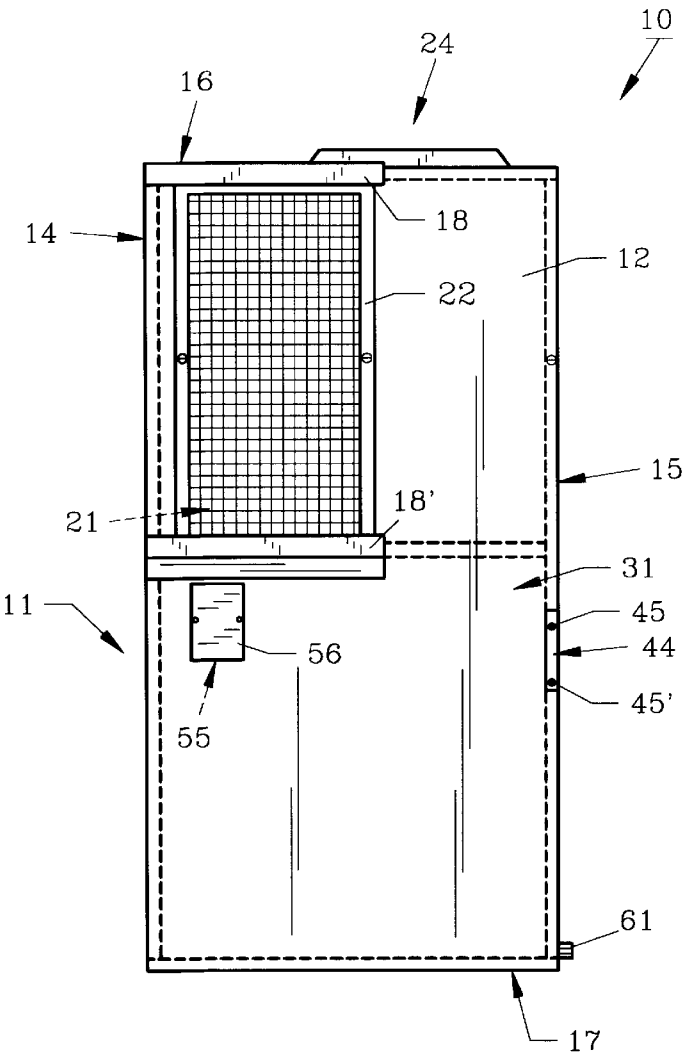
FIG. 1 shows an elevational front view of the preferred heat pump of the present invention.
Figure 4:
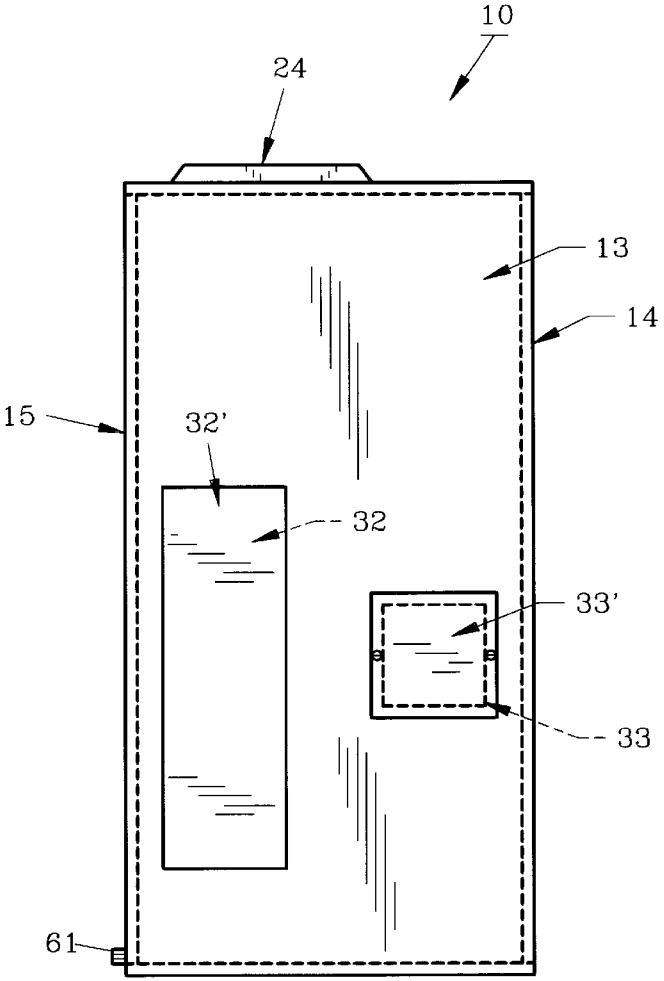
FIG. 4 demonstrates an elevational back side view of the heat pump of FIG. 1.
Figure 3:
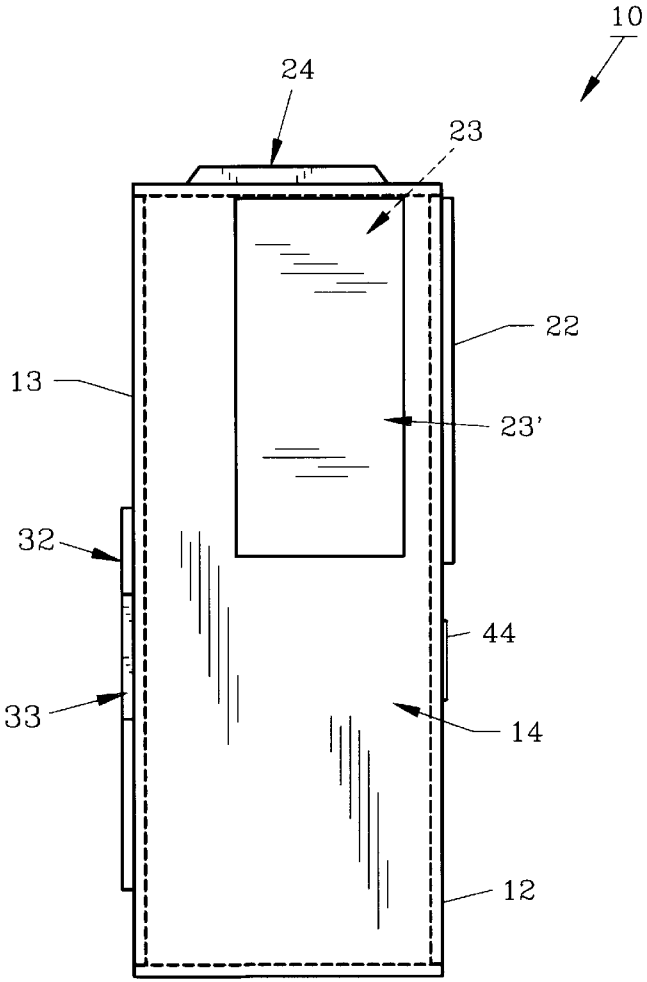
FIG. 3 pictures an elevational left side view of the heat pump of FIG. 1.

Turning now to the drawings, specifically FIGS. 1–4 show uninstalled elevational views of the exterior of preferred heat pump 10, which includes housing 11. Housing 11 is preferably made of metal such as aluminum or steel, and is generally rectangular in shape. Housing 11 is preferably 170.18 cm tall, 53.34 cm deep (front to back) and 76.2 cm wide (right to left). Housing 11 includes front side 12, back side 13, left side 14, right side 15, top 16 and bottom 17. It should be understood that heat pump 10 could be installed in any orientation, with any side being the "front." Top 16 defines first exhaust opening 24, which is adapted for use with standard air ducts, so as to carry conditioned air to a desired location in the building. Front side 12 defines first intake opening 21 which is obscured and covered by conventional air filter 22. First intake opening 21 is adapted for use as a free return as is well understood. Lower front panel 31 is removable and allows access to the interior of heat pump 10. Lower front panel 31 defines opening 55 filled by cover 56 which allows access to circuit breakers 54 (seen in FIG. 5). Also seen in FIG. 1 is panel 44 attached to housing 11 by fasteners 45 and 45'. Panel 44 allows access to Schrader valves 43 and 43' (seen in FIG. 10). FIG. 2 shows right side 15 which is rectangular in shape. Proximate bottom 17, exterior condensate drain pipe 61 extends through housing 11. FIG. 3 illustrates second intake opening 23, which is covered by panel 23' and is adapted to be used with a typical duct return. FIG. 4 pictures back side 13, which defines third intake opening 32 and second exhaust opening 33 covered by panels 32' and 33' respectively. It should be understood that panels 32' and 33' are removed immediately prior to installation so that air circulates through said openings. Panel 23' may be removed as needed and will be explained in greater detail below.

Figure 5:
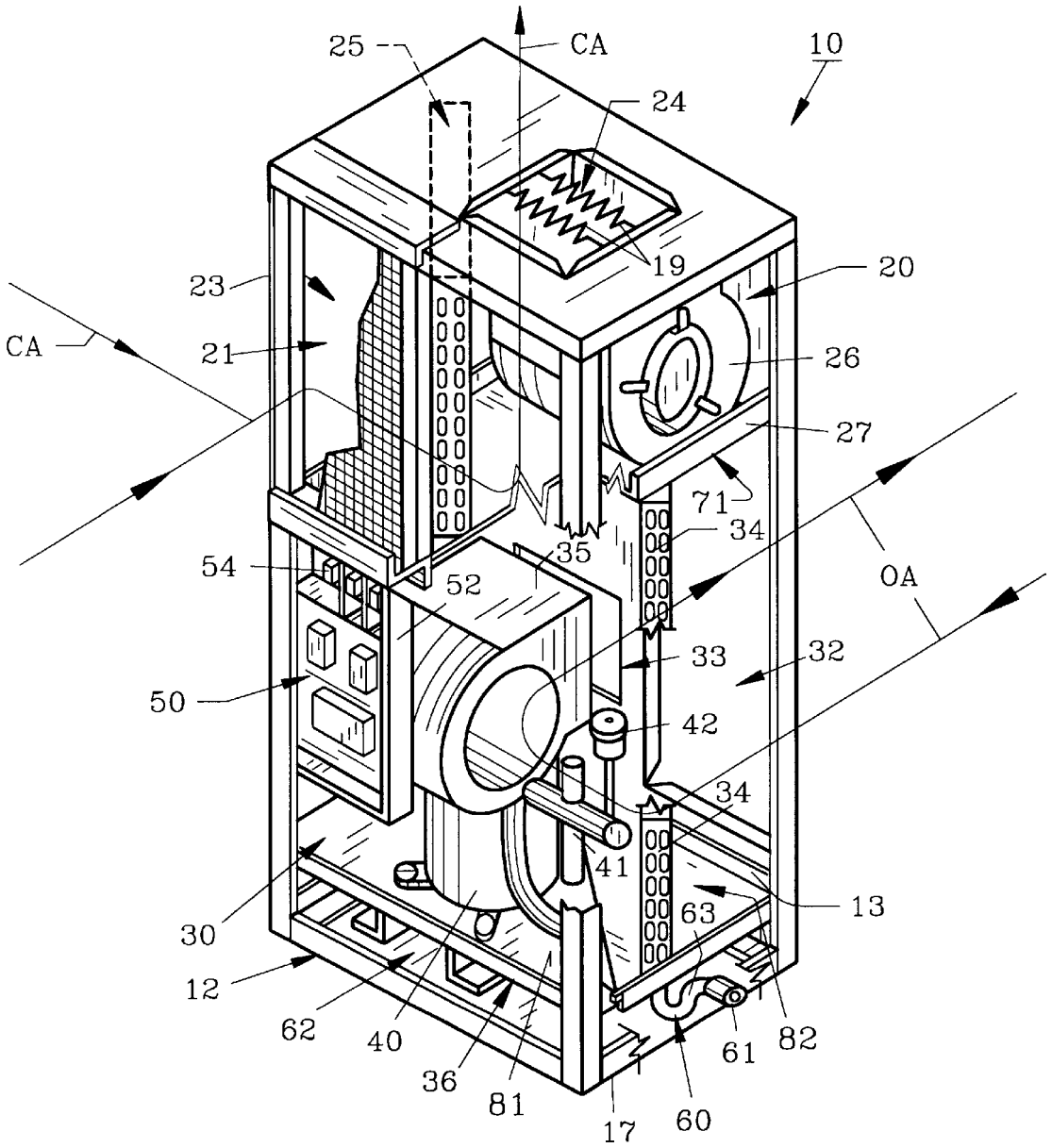
FIG. 5 depicts a perspective cut-away view of the heat pump of the present invention.

FIG. 5 shows a perspective cut-away view of preferred heat pump 10, which includes first chamber 20 and second chamber 30. First chamber 20 circulates conditioned air as generally seen by arrows CA. Second chamber 30 circulates outside or unconditioned air as generally seen by arrows OA. Conventional first blower 26 draws air selectively through either first intake opening 21 or second intake opening 23 and through first conventional evaporator/condenser coil 25 whereupon the air is conditioned as is conventional. Note that an evaporator/condenser coil is called such because in one cycle, the coil acts as an evaporator and in the other cycle, the coil reverses function and acts as a condenser. Those of ordinary skill in the art understand which cycle requires which function. The diagonal positioning of evaporator/condenser coil 25 as shown allows either intake opening 21 or 23 to be used without repositioning evaporator/condenser coil 25. Diagonal in this context means the slant that is created by coil 25 as between front side 12 and left side 14. While this diagonal could also be formed at any corner (e.g. front 12 and right 15; back 13 and left 14; back 13 and right 15), such is not preferred. This also refers to the positioning of evaporator/condenser coil 25 in a horizontally slanted position as opposed to prior heat pumps having vertically slanted coils. In use, only one of the intake openings 21 or 23 would be used, but by providing both in one heat pump, the heat pump is more versatile and more easily adapted for use in any configuration. Note that in one configuration panel 23' must be removed and placed over opening 21; otherwise panel 23' remains installed on left side 14. Air, once drawn into chamber 20, is then redirected upwardly and out first exhaust opening 24. Prior to exiting exhaust opening 24, the air passes over conventional resistive heating elements 19 for additional heating as desired and as is well understood. The air then passes into conventional duct work (not shown in FIG. 5) for redirection and delivery to desired locations within the building. Thus, intake openings 21 and 23 are in fluid communication with evaporator/condenser coil 25 and blower 26 which are in turn in fluid communication with exhaust opening 24. First blower 26 is attached to and mounted on housing 11 by conventional fasteners (not shown). First chamber 20 includes drain shelf 27 which has a generally s-shaped configuration. Drain shelf 27 supports evaporator/condenser coil 25 and collects all condensate that forms thereon. Aperture 73 (seen in FIG. 11) is provided which in turn is connected to pipes (not shown) which provide fluid communication with drain trap assembly 60 as will be explained in greater detail below. Coil 25 rests on lower level 72 (FIG. 11) of drain shelf 27.

In FIG. 5, second chamber 30 is beneath first chamber 20, and is separated therefrom by drain shelf 27. Second chamber 30 includes second conventional evaporator/condenser coil 34 which is proximate back side 13. Unconditioned or outside air is drawn in third intake opening 32 and through second evaporator/condenser coil 34 by second blower 35. The air is then redirected out second exhaust opening 33. Thus, second evaporator/condenser coil 34 is in fluid communication with third intake opening 32 and second blower 35, which are in turn in fluid communication with second exhaust opening 33. As noted above, panels 32' and 33' are removed so that this fluid communication occurs and allows heat pump 10 to be placed inside a building proximate only interior walls if desired. When used like this, duct work (not shown in FIG. 5) connects heat pump 10 to a source of unconditioned air as is conventional. Other arrangements are possible and are discussed elsewhere in the specification. Conventional compressor 40 is also within second chamber 30. Compressor 40 is mounted on second drain shelf 36, which also has a generally s-shaped configuration. Second evaporator/condenser coil 34 rests on lower section 82 (better seen in FIGS. 12 and 13) of second drain shelf 36 and extends upward until it abuts upper level 71 (FIG. 11) of first drain shelf 27. This arrangement effectively, vertically overlaps first evaporator/condenser coil 25 and second evaporator/condenser coil 34, (better seen in FIG. 13) thus allowing the height of heat pump 10 to be shorter than prior art heat pumps.

Also within second chamber 30 is conventional reversing valve 41 and conventional expansion valve 42 which are in fluid communication with first and second evaporator/condenser coils as is conventional. These valves control the cooling agent (not shown) within evaporator/condenser coils 25 and 34.

Still looking at FIG. 5, proximate front side 12 and within second chamber 30 rests control box 50. Control box 50 contains conventional circuit breakers 54 and other conventional electrical circuitry to provide power to the various elements of heat pump 10. Romex connectors 51 in left side 14 allow wires (not shown) to be drawn into the interior of control box 50 as is conventional. Control box 50 is isolated within chamber 30 by box housing 52 which is mounted directly on housing 11 by conventional fasteners such as bolts or screws.

Beneath second drain shelf 36 and spaced therefrom is bottom 17. Between second drain shelf 36 and bottom 17 is third chamber 62 which includes therein drain trap assembly 60. Both drain shelves 27 and 36 drain through pipes (not shown) into conventional u-shaped trap 63 which then connects to exterior pipe 61 and extends through right side 15. Exterior pipe 61 can extend through any side 12–15, but right side 15 is preferred. By including drain trap assembly 60 inside heat pump 10, the installer is saved the trouble of having to assemble and connect a full trap outside of housing 11 as in prior art heat pumps. Traps are needed because the chambers operate at negative pressure; the traps allow condensate draining to occur despite this negative pressure. Exterior pipe 61 is connected to a sewer line (not shown) or otherwise allowed to drain heat pump 10, which saves labor and installation time.

Figure 6:
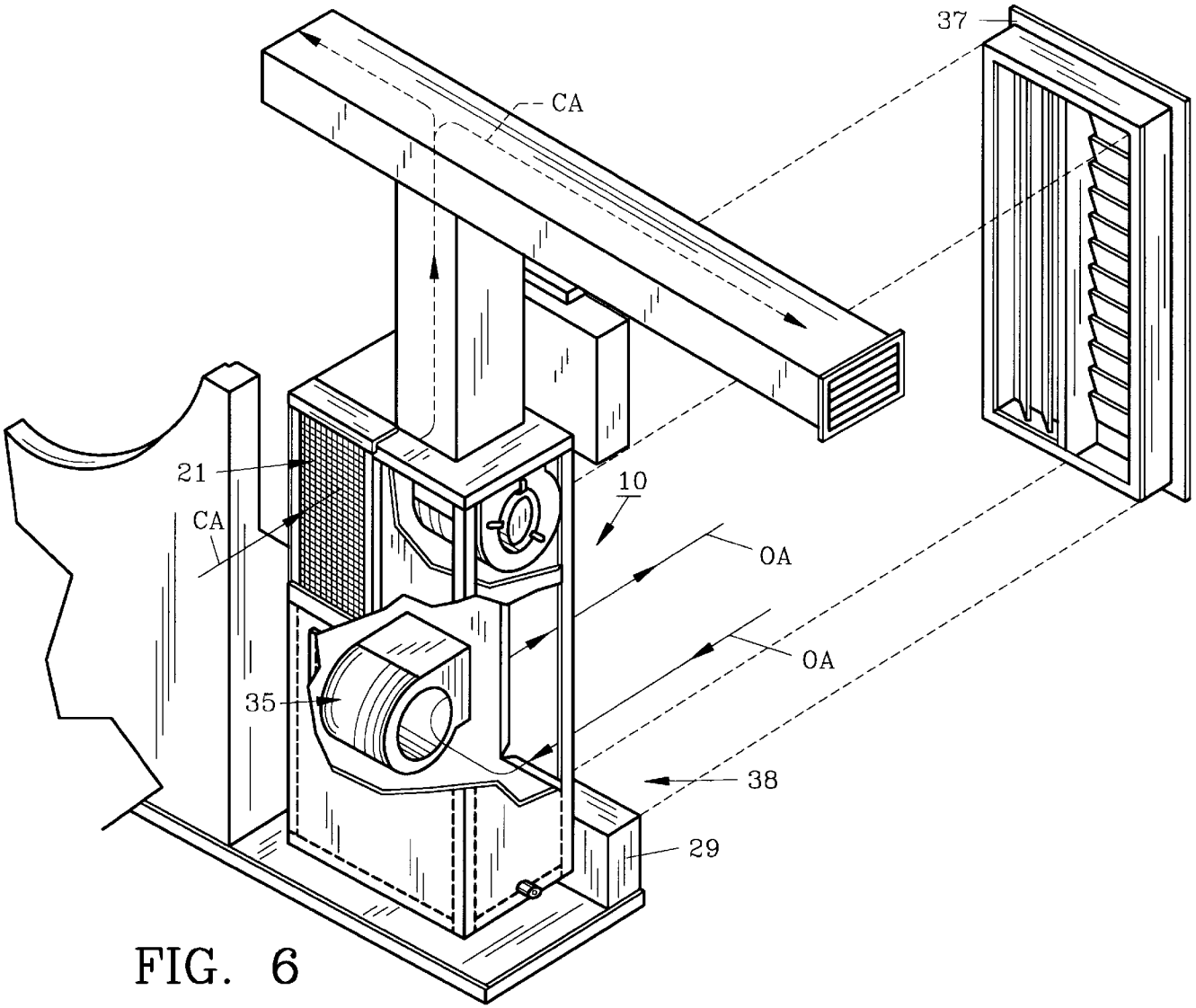
FIG. 6 illustrates an exploded perspective view of the heat pump of FIG. 1 as installed.
Figure 7:
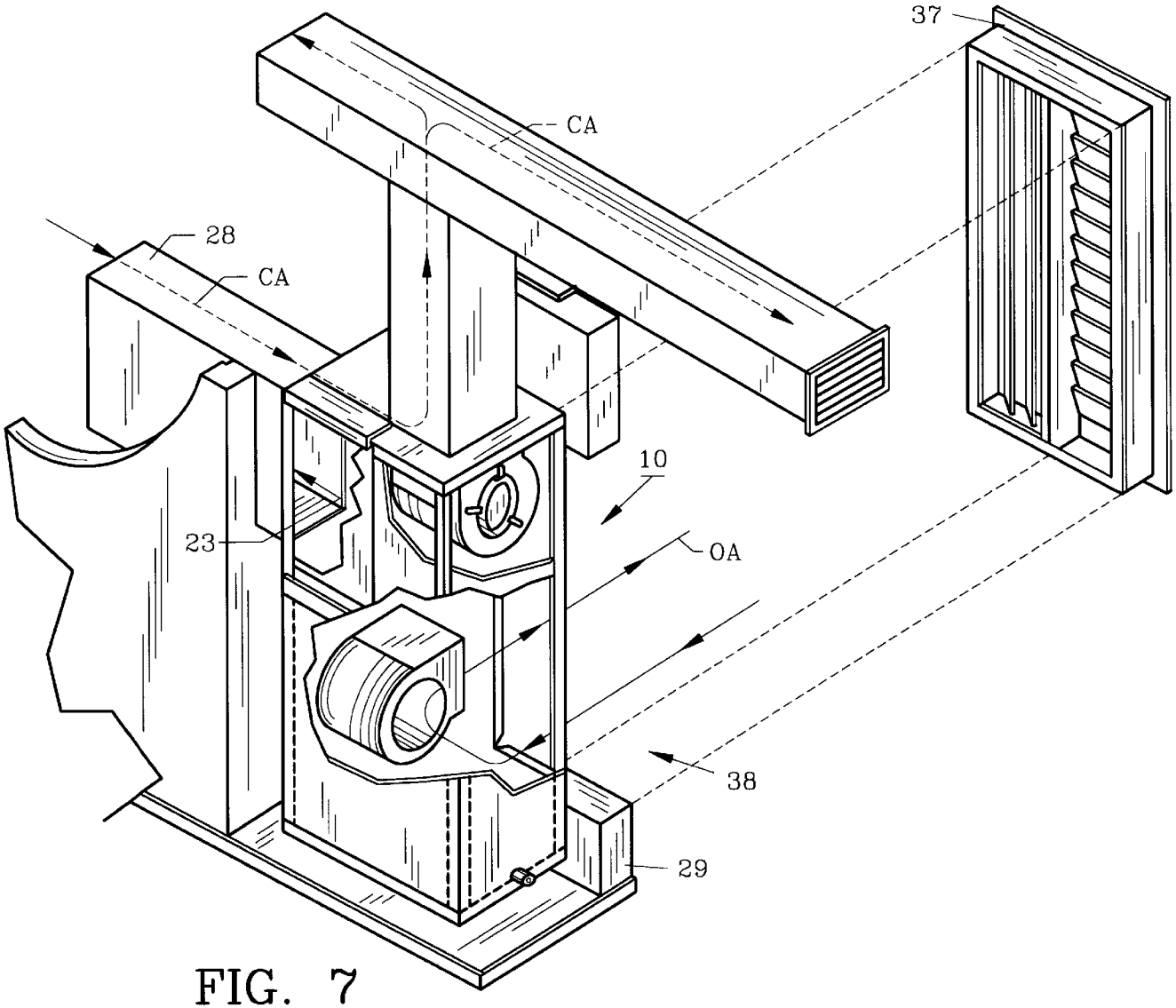
FIG. 7 demonstrates the perspective view of FIG. 6 with an alternate intake configuration.

Heat pump 10 has two possible conditioned air configurations as seen in FIGS. 6 and 7. As noted above, it is this flexibility in use that makes heat pump 10 preferred. In FIG. 6, the return air passes through first intake opening 21. This is useful when heat pump 10 is located within the building such that there is no need to bring air to heat pump 10. In FIG. 7, air is brought to heat pump 10 by duct work 28 which is in fluid communication with second intake opening 23. In both FIGS. 6 and 7, it is assumed that heat pump 10 is against exterior wall 29. Exterior wall 29 defines an opening 38 so that wall sleeve and louver 37 can be installed. Wall sleeve and louver 37 allow outside air to enter second chamber 30 and then exit as is conventional and shown by arrows OA. When not near exterior wall 29, unconditioned air is brought to heat pump 10 by conventional duct work (not shown).

Figure 8:
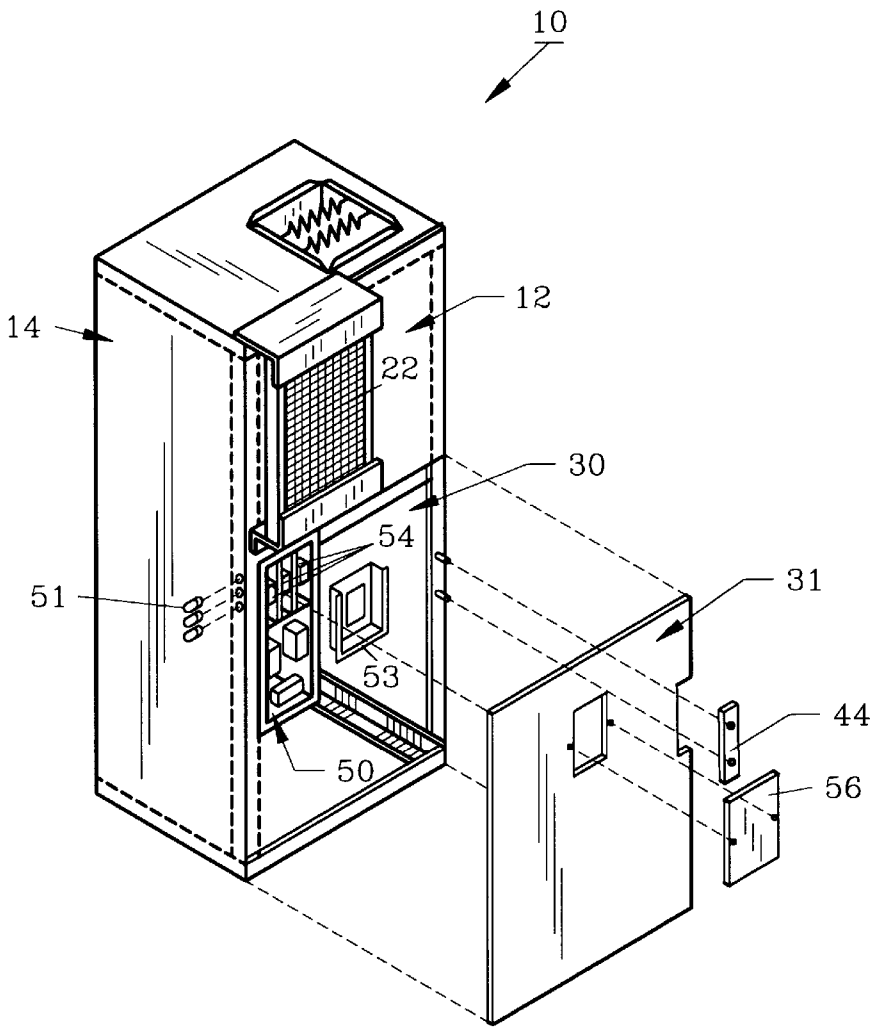
FIG. 8 features a different exploded view of the heat pump of FIG. 1 highlighting the front panel arrangement.
Figure 9:
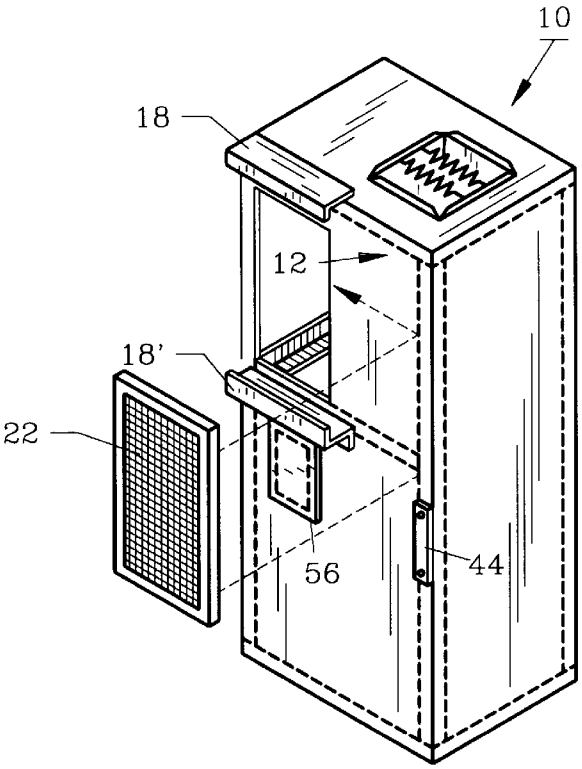
FIG. 9 pictures a schematic view of the method of installing an air filter on the heat pump of FIG. 1.
Figure 10:
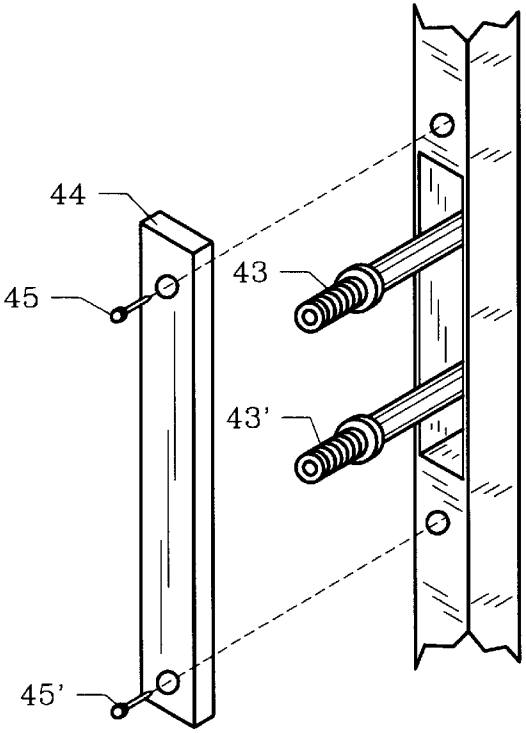
FIG. 10 depicts a partial enlarged view of the Schrader valves and cover of the heat pump of FIG. 1.

FIGS. 8–10 show exploded views of additional features on preferred heat pump 10. In FIG. 8, left side 14 and front side 12 are shown with air filter 22 in place and romex connectors 51 exploded from left side 14. As should be understood, romex connectors 51 are vertically positioned so as to align with control box 50 and allow wiring to be passed into control box 50 as is conventional. Control box 50 includes circuit breaker cover 53 which holds conventional circuit breakers 54 in place. Second chamber 30 is closed by lower front panel 31, which fits over control box 50 and lies flush thereagainst. It should be understood that conventional fasteners hold control box 50 in place as well as lower front panel 31, circuit breakers 54 and circuit breaker cover 53 as is well understood in the art.

FIG. 9 provides a schematic for the installation of conventional air filter 22. Filter rails 18 and 18' are generally 1-shaped and span approximately one-half the width of front 12. Filter rails 18 and 18' allow air filter 22 to slide into position and filter air passing through first opening 21. The preferred method of installing air filter 22 is to slide the used air filter to the right as the installer faces heat pump 10, thereby removing the used air filter from filter rails 18 and 18' and then pull forward. To install air filter 22, the installer places air filter 22 to the right of filter rails 18 and 18' and slides air filter 22 to the left, engaging filter rails 18 and 18' so as to hold air filter 22 in position.

FIG. 10 shows a blow up of Schrader valves 43 and 43' on the right front side 12 of housing 11. Schrader valves 43 and 43' normally lie behind Schrader panel 44, but can be pulled outwardly as is conventional for pressure readings by an individual servicing heat pump 10. Schrader panel 44 is held in place by conventional fasteners 45 and 45' such as screws or bolts. This positioning of Schrader valves 43 and 43' allows easy access and helps contribute to the ability to service all components from front side 12 of housing 11. Schrader valves 43 and 43' are in fluid communication with reversing valve 41 and expansion valve 42 as is conventional.

Figure 12:
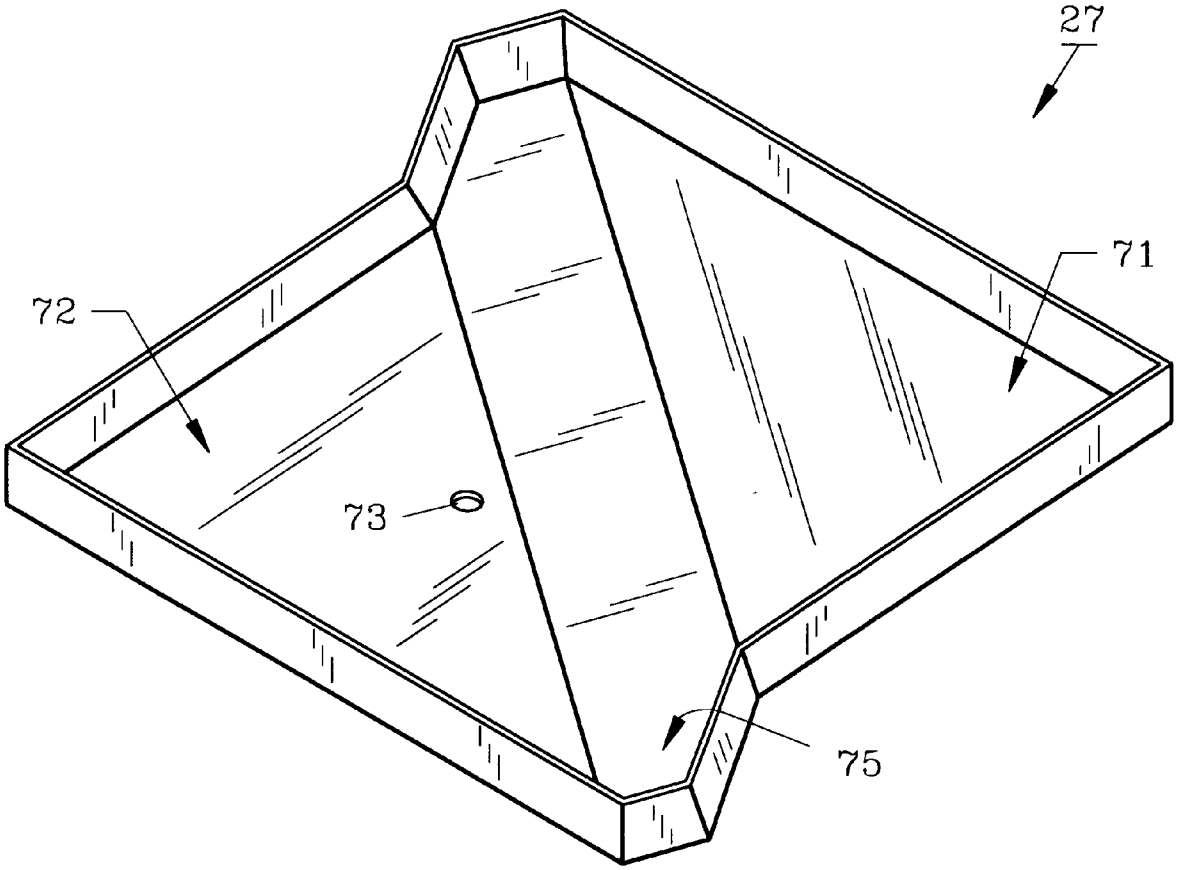
FIG. 12 illustrates a perspective view of the top drain shelf of the present invention removed from the heat pump.
Figure 13:
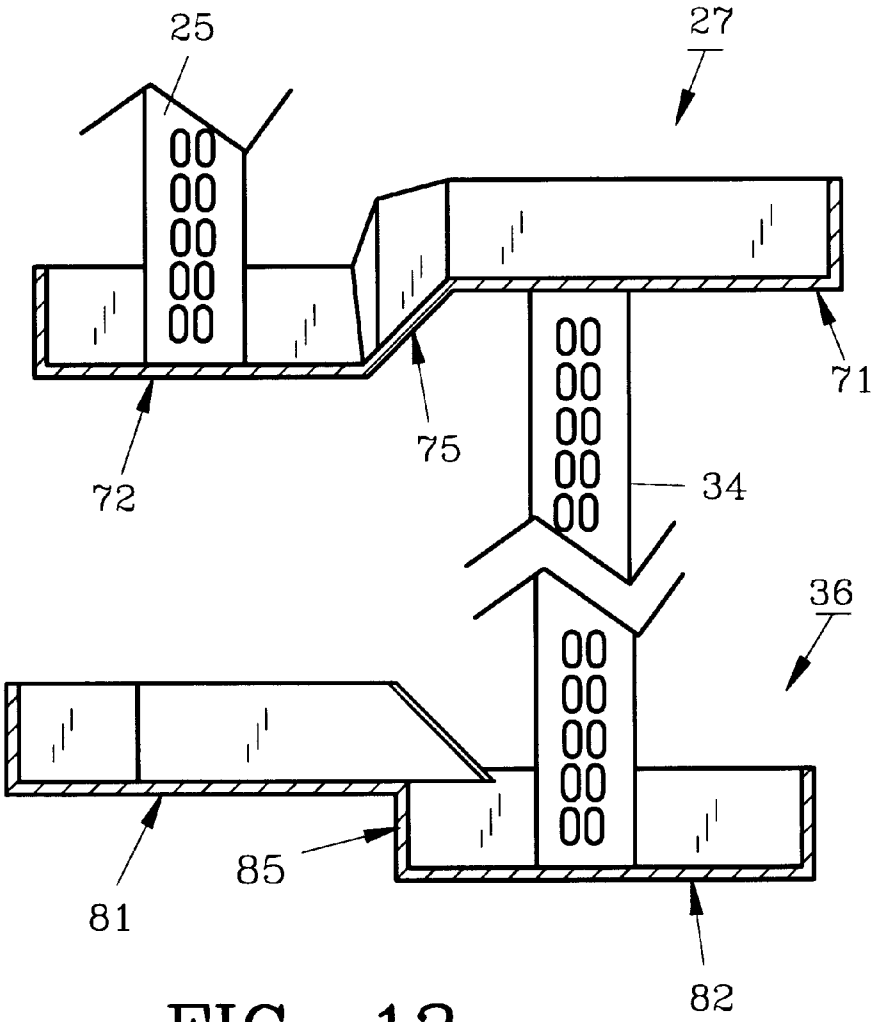
FIG. 13 features a partial cross sectional side view of the drain shelves and the overlapping arrangement of the evaporator/condenser coils.

First drain shelf 27 is seen in FIGS. 12 and 13. Drain shelf 27 has a somewhat s-shaped configuration, with upper level 71 and lower level 72 spaced by slanted vertical component 75 (best seen in FIG. 13). Drain aperture 73 is defined by lower level 72 and is well suited for connection to a drain pipe (not shown) which can in turn be connected to drain trap assembly 60 so that condensate that forms on evaporator/condenser coil 25 may be properly drained.

Figure 11:
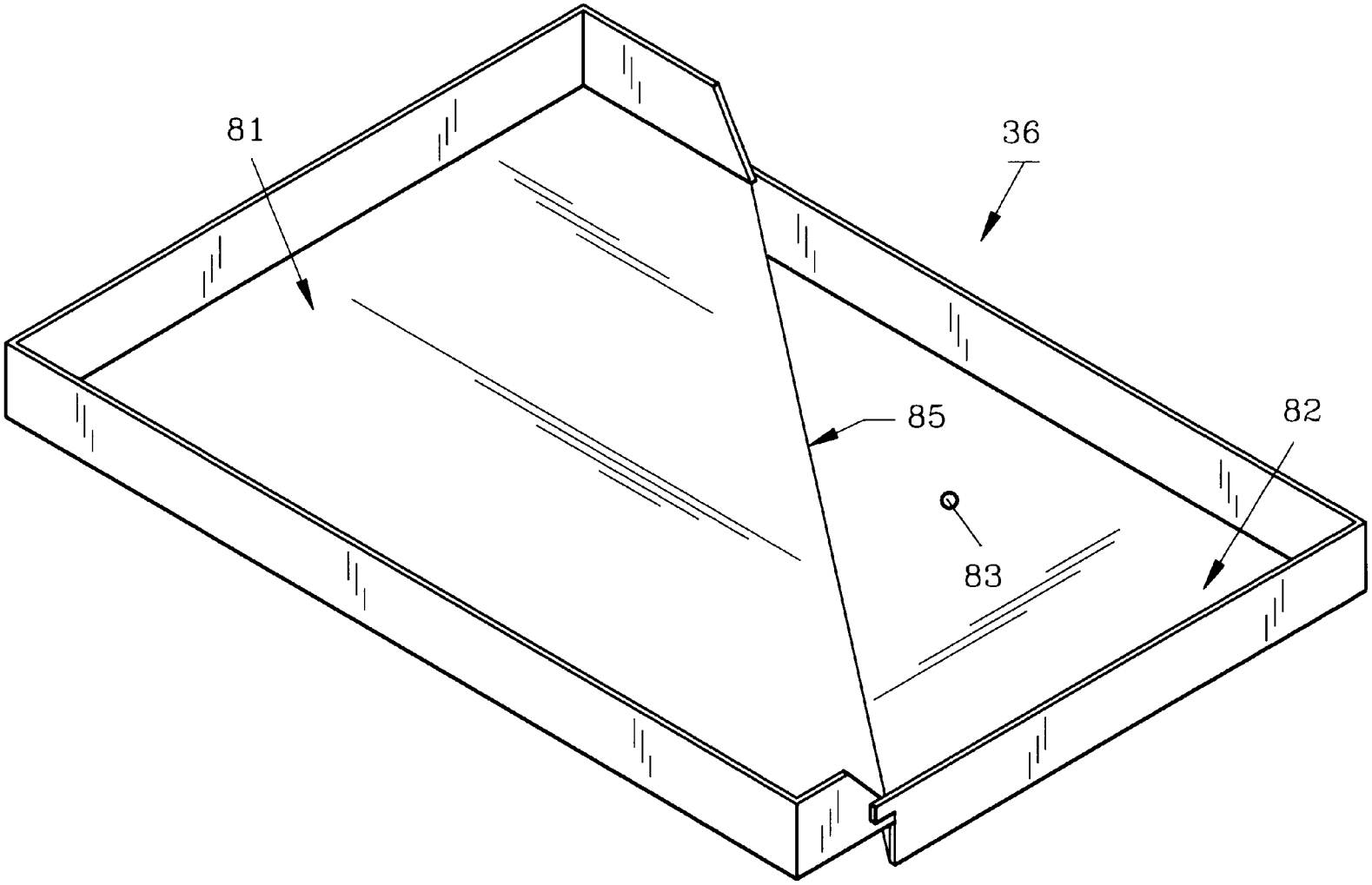
FIG. 11 shows a perspective view of the bottom drain shelf of the present invention removed from the heat pump.

Second drain shelf 36 is seen in FIGS. 11 and 13. Drain shelf 36 has a more abrupt s-shaped configuration, with upper level 81 and lower level 82, separated by vertical component 85 (better seen in FIG. 13). Drain aperture 83 is defined by lower level 83 and functions much like drain aperture 73. Compressor 40 is mounted on upper level 81 by conventional fasteners, and second evaporator/condenser coil 34 is mounted on lower level 82 by conventional fasteners. Drain shelf 36 is positioned so that lower level 82 is below upper level 71, and upper level 81 is below lower level 72. This allows more vertical room for evaporator/condenser coil 34 by effectively vertically overlapping evaporator/condenser coils 34 and 25. This arrangement also mounts evaporator/condenser coils 25 and 34 on lower portions 72 and 82 in order to drain said evaporator/condenser coils properly.

The preceding recitation is provided to describe the preferred embodiment and is not meant to limit the nature or scope of the appended claims.

We claim:

1. In a heat pump including a housing and at least two chambers within said housing, the first of said chambers for conditioning air and the second of said chambers for circulating unconditioned air, the improvement comprising:

a drain shelf, said drain shelf separating said first and said second chambers, said shelf having a somewhat s-shaped configuration, said drain shelf comprising an upper horizontal level and a lower horizontal level, said upper level spaced from said lower level by a slanted vertical component, said lower level defining a drain aperture.

2. The heat pump of claim 1 further comprising a first evaporator/condenser coil and a second evaporator/condenser coil, said first evaporator/condenser coil disposed in said first chamber, said second evaporator/condenser coil disposed in said second chamber.

3. The heat pump of claim 2 wherein said first evaporator/condenser coil rests on said lower horizontal level and said second evaporator/condenser coil abuts said upper horizontal level to vertically overlap said coils.

4. The heat pump of claim 1 wherein said housing defines a plurality of intake openings.

5. The heat pump of claim 4 wherein said first chamber is in fluid communication with a plurality of intake openings.

6. The heat pump of claim 1 further comprising a drain trap, said drain trap disposed within said housing.

7. The heat pump of claim 6 wherein said housing defines a footprint and said drain shelf spans the entire footprint.

8. A heat pump comprising:

a housing, said housing defining a plurality of intake openings;

a first evaporator/condenser coil, said first evaporator/condenser coil in fluid communication with said plurality of intake openings;

a drain shelf, said drain shelf disposed in said housing, said drain shelf having a generally s-shaped configuration;

and a drain trap, said drain trap disposed within said housing below said drain shelf, said drain shelf in fluid communication with said drain trap.

9. The heat pump of claim 8 further comprising a first floor and a second floor, said first and second floors contained in said housing, said drain trap between said first and second floors.

10. The heat pump of claim 8 wherein said housing defines a drain opening, said drain opening proximate said drain trap.

11. The heat pump of claim 8 further comprising a plurality of Schrader valves, said Schrader valves contained within said housing.

12. The heat pump of claim 11 further comprising a removable service cover, said service cover disposed on said housing, said service cover allowing access to said Schrader valves.

13. The heat pump of claim 1 further comprising a second drain pan, a second drain shelf, said second drain shelf positioned beneath said first drain shelf.

14. The heat pump of claim 13 wherein said second drain shelf comprises a generally s-shaped configuration.

15. The heat pump of claim 13 wherein said second drain shelf comprises an upper horizontal level and a lower horizontal level, said upper horizontal level spaced from said lower horizontal level by a vertical component.

16. The heat pump of claim 15 wherein said second evaporator/condenser coil rests on said lower level of said second drain shelf.

17. The heat pump of claim 13 further comprising a compressor, said compressor mounted on said second drain shelf.

18. The heat pump of claim 2 wherein said first evaporator/condenser coil and said second evaporator/condenser coil are diagonally positioned within their respective chambers.

19. The heat pump of claim 8 wherein said first evaporator/condenser coil is diagonally positioned in said housing.

20. In a heat pump having a rectangular housing with upright vertical side walls, and containing first and second evaporator/condenser coils in separate compartments, the improvement comprising:

said first evaporator/condenser coil in vertical parallel alignment with said second evaporator/condenser coil;

said first evaporator/condenser coil diagonally positioned between an adjoining pair of said side walls; and an s-shaped drain shelf, said s-shaped drain shelf positioned between said first and said second evaporator/condenser coils.

* * * * *